US006722234B2

(12) United States Patent
Hu

(10) Patent No.: US 6,722,234 B2
(45) **Date of Patent: *Apr. 20, 2004**

(54) EASY-TO-OPERATE AND EASY-TO-ASSEMBLE RATCHETING-TYPE WRENCH

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/888,810

(22) Filed: Jun. 25, 2001

(65) Prior Publication Data

US 2002/0166416 A1 Nov. 14, 2002

Related U.S. Application Data

(63) Continuation-in-part of application No. 09/854,795, filed on May 14, 2001.

(30) Foreign Application Priority Data

May 16, 2001 (TW) ..... 90207990 U

(51) Int. Cl.[7] ..... B25B 13/46
(52) U.S. Cl. ..... 81/63.2; 192/43.2
(58) Field of Search ..... 81/63.2, 63, 63.1, 81/62, 61, 60, 58.4; 192/43.2

(56) References Cited

U.S. PATENT DOCUMENTS

| | | | | |
|---|---|---|---|---|
| 15,482 A | | 8/1856 | Gilman | |
| 810,599 A | | 1/1906 | Ansorge | |
| 841,686 A | | 1/1907 | Hatfield | |
| 893,097 A | | 7/1908 | Reams | |
| 915,446 A | | 3/1909 | Kearnes | |
| 1,033,358 A | | 7/1912 | Turner | |
| 1,194,471 A | | 8/1916 | Boosinger | |
| 1,261,092 A | | 4/1918 | Allen | |
| 1,382,492 A | | 6/1921 | Evans | |
| 1,426,127 A | | 8/1922 | Tuttle | |
| 1,614,039 A | | 1/1927 | Mandl | |
| 1,957,462 A | * | 5/1934 | Kress | 81/63 |
| 2,317,461 A | | 4/1943 | Jackson | |
| 2,542,241 A | | 2/1951 | Fors | |
| 2,657,604 A | | 11/1953 | Rueb | |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—Hadi Shakeri
(74) *Attorney, Agent, or Firm*—Alan Kamrath

(57) ABSTRACT

A wrench comprises a handle and a head extended from the handle. A web is defined between the handle and the head. The head includes a compartment in which a drive member is rotatably received. The web includes a transverse through-hole having an intermediate portion communicated with the compartment. A cavity is defined in the web and communicated with the transverse through-hole. A switch member is mounted in the cavity and rotatable relative to the handle between two positions corresponding to two opposite ratcheting directions of the handle. A pawl is slidably mounted in the transverse through-hole for engaging with the drive member. The pawl remains in the transverse through-hole during operation. A pin and a coil spring are provided to retain the pawl in place.

20 Claims, 20 Drawing Sheets

U.S. PATENT DOCUMENTS 2,701,977 A * 2/1955 Stone ..... 81/63.2
2,764,048 A 9/1956 Thompson
2,769,360 A 11/1956 Cottrell et al.
2,800,821 A 7/1957 Fruscella
2,891,434 A 6/1959 Lozensky
2,957,377 A * 10/1960 Hare ..... 81/63.2
3,019,682 A 2/1962 Hare
3,250,157 A 5/1966 Badger
3,265,171 A * 8/1966 Kilness ..... 81/63
3,337,014 A 8/1967 Sandrick
3,393,587 A 7/1968 Jolliff et al.
3,393,780 A 7/1968 Kilness
3,436,992 A 4/1969 Over et al.
3,577,816 A 5/1971 Alexander et al.
3,713,356 A 1/1973 Knudsen
3,742,788 A 7/1973 Priest
3,838,614 A 10/1974 O'Donnell
3,908,487 A 9/1975 Plaw
4,070,932 A 1/1978 Jeannotte
4,111,077 A 9/1978 Cummings et al.
4,128,025 A 12/1978 Main et al.
4,274,311 A 6/1981 Ebert
4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Deibert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus
4,796,492 A 1/1989 Liou
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A * 2/1991 Lee ..... 81/60
5,012,705 A 5/1991 Chow
5,076,121 A 12/1991 Fosella
5,144,869 A 9/1992 Chow
5,157,994 A 10/1992 Krivec
5,178,047 A 1/1993 Arnold et al.
5,199,330 A 4/1993 Arnold et al.
5,199,335 A 4/1993 Arnold et al.
5,230,262 A 7/1993 Ahlund et al.
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,499,560 A 3/1996 Aeschliman
5,501,124 A 3/1996 Ashby
5,509,333 A 4/1996 Rion
5,533,427 A 7/1996 Chow
5,557,994 A 9/1996 Nakayama
5,595,095 A 1/1997 Hillinger
5,626,061 A 5/1997 Whitley
5,626,062 A 5/1997 Colvin
5,636,557 A 6/1997 Ma
5,709,137 A 1/1998 Blacklock
5,782,147 A 7/1998 Chaconas et al.
5,794,496 A 8/1998 Arnold
5,829,326 A 11/1998 Richner
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A 10/2000 Chaconas
D433,896 S 11/2000 Wei
6,148,695 A 11/2000 Hu
6,152,826 A 11/2000 Profeta et al.
6,161,454 A 12/2000 Chaconas
6,164,167 A 12/2000 Chen
6,216,563 B1 * 4/2001 Hsieh ..... 81/63.2
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,991 B1 9/2001 Hu
6,282,992 B1 9/2001 Hu
6,301,998 B1 10/2001 Hu

* cited by examiner

EASY-TO-OPERATE AND EASY-TO-ASSEMBLE RATCHETING-TYPE WRENCH

CROSS REFERENCE TO RELATED APPLICATION

This is a continuation-in-part application of copending U.S. patent application Ser. No. 09/854,795 filed on May 14, 2001.

BACKGROUND OF THE INVENTION

1. Field of the Invention

The present invention relates to an easy-to-operate and easy-to-assemble ratcheting-type wrench.

2. Description of the Related Art

Several factors are considered in designing wrenches and spanners, including improving the torque-bearing capacity, providing as many teeth as possible for the drive member, and providing an easy-to-manufacture structure. FIG. 14 of the drawings illustrates a conventional wrench of the type having a handle B' and a head in which a drive member A' is rotatably received. A pawl D' is slidably received in a transverse through-hole C' in a web between the handle B' and the head. However, an end of the pawl D' extends beyond the transverse through-hole C' and thus adversely affects operation of the wrench when used in a limited space. A two-pawl type wrench was proposed to solve this problem. As illustrated in FIGS. 15 through 17, the two-pawl type wrench includes a handle 1' and a head 11' extended from the handle 1'. A drive member 2' is rotatably received in the head 11', a receptacle 12' is defined in a web between the handle 1' and the head 11', and a spring-biased switch member 4' is mounted in a cavity 13' in the web. Two spaced pawls 3' are received in the receptacle 12' and are biased by two springs 6', respectively. A threaded end cap 5' is engaged with a threaded outer end 121' of the receptacle 12' to enclose the pawls 3' and springs 6'. As illustrated in FIGS. 16 and 17, the switch member 4' is turned to bias one of the pawls 3' to engage teeth 31' thereof with the drive member 2' to thereby change the ratcheting direction of the wrench. However, it was found that the switch member 4' cannot be reliably retained in place and thus tends to disengage from the cavity 13'. In addition, the pawl 3' engaged with the drive member 2' is not engaged with an inner longitudinal wall that defines the transverse through-hole and that faces the drive member 2'. As a result, the torque-bearing capacity of the wrench is poor. Furthermore, the outer pawl 3' (FIGS. 16 and 17) tends to get stuck when the threaded end cap 5' is mounted too close to the switch member 4'. On the other hand, if the threaded end cap 5' is too far away from the switch member 4', the pawl 3' cannot be firmly engaged with the drive member 2'. Further, the threaded end cap 5' tends to be disengaged from the web between the handle 1' and the head 11', as the former is in threading engagement with the threaded outer end 121' of the receptacle 12'.

FIGS. 18 through 20 illustrate another conventional wrench having a substantially V-shape transverse through-hole 25' in a web between a handle 20' and a head 21' thereof. The head 21' includes a compartment in which a drive member 22' is rotatably received. A spring-biased pawl 23' is received in each limb of the V-shape transverse through-hole 25'. A switch member 30' includes a stem 35' pivotally received in a cavity 24' in the web and a thumb-piece 32' extending from the stem 35' for manual operation, thereby switching the switch member 30' between two positions corresponding to two opposite ratcheting directions of the wrench. The thumb piece 32' of the switch member 30' includes a downwardly facing receptacle 36' (FIG. 20) for receiving a spring 37' and a ball 38' that is biased by the spring 37' to be positioned in one of two positioning recesses 281' (FIG. 19) in a sector-like recessed area 28' (FIG. 18) of the web. The switch member 30' may be retained in place reliably. However, a C-clip 33' is required for mounting the switch member 30' in place. In addition, processing of the sector-like recessed area 28' in the web and the V-shape transverse through-hole 25' is difficult. Mounting of the switch member 30' as well as the pawl 23' and associated springs 26' and threaded end caps 27' are troublesome and time-consuming. The sector-like recessed area 28' in the web results in an increase in the overall thickness of the wrench, which limits application of the wrench in limited spaces.

U.S. Pat. No. 6,282,991 discloses a biasing arrangement for a pawl of a reversible ratchet-type wrench. However, the pawl protrudes beyond the handle during change in the ratcheting direction and thus adversely affects operation of the wrench in a limited space, as the protruded portion of the pawl tends to impinge on an object in the limited space.

SUMMARY OF THE INVENTION

It is an object of the present invention to provide an easy-to-operate and easy-to-assemble ratcheting-type wrench.

In accordance with a first aspect of the invention, a wrench comprises:

a handle comprising a first lateral side and a second lateral side opposite to the first lateral side;

a head extended from the handle, a web being defined between the handle and the head, the head including a compartment, the web including a transverse through-hole having an intermediate portion communicated with the compartment, the transverse through-hole extending from the first lateral side to the second lateral side of the handle, a cavity being defined in the web and communicated with the transverse through-hole;

a drive member rotatably mounted in the compartment of the head and including a plurality of teeth on an outer periphery thereof;

a switch member mounted in the cavity and rotatable relative to the handle between two positions corresponding to two opposite ratcheting directions of the handle; and a pawl mounted in the transverse through-hole and slidable along a lengthwise direction of the transverse through-hole, with the pawl remaining in the transverse through-hole during operation, the pawl including a first lateral side facing the compartment and a second lateral side facing away from the compartment, the first lateral side of the pawl including a first toothed portion and a second toothed portion that are selectively engaged with the teeth of the drive member according to one of the positions of the switch member relative to the handle, a groove being defined in the second lateral side of the pawl and including a first corner and a second corner;

the handle including an upper side, the cavity including a vertical portion extending to the upper side of the handle, the switch member including a column rotatably received in the vertical portion of the cavity, the column having a transverse hole that faces the groove of the pawl;

a coil spring mounted in the transverse hole of the column and having an enlarged portion abutting against an outer periphery of the column and surrounding the transverse hole of the column; and a pin having a first end received in the coil spring and a second end received in the groove of the pawl, the second end of the pin being biased by the coil spring to be selectively, securely engaged in one of the first corner and the second corner of the groove of the pawl that corresponds to said one of the positions of the switch member relative to the handle.

In accordance with a second aspect of the invention, a wrench comprises:

a handle comprising a first lateral side and a second lateral side opposite to the first lateral side;

a head extended from the handle, a web being defined between the handle and the head, the head including a compartment, the web including a transverse through-hole having an intermediate portion communicated with the compartment, the transverse through-hole extending from the first lateral side to the second lateral side of the handle, a cavity being defined in the web and communicated with the transverse through-hole;

a drive member rotatably mounted in the compartment of the head and including a plurality of teeth on an outer periphery thereof;

a switch member mounted in the cavity and rotatable relative to the handle between two positions corresponding to two opposite ratcheting directions of the handle; and a pawl mounted in the transverse through-hole and slidable along a lengthwise direction of the transverse through-hole, with the pawl remaining in the transverse through-hole during operation, the pawl including a first lateral side facing the compartment and a second lateral side facing away from the compartment, the first lateral side of the pawl including a first toothed portion and a second toothed portion that are selectively engaged with the teeth of the drive member according to one of the positions of the switch member relative to the handle, a groove being defined in the second lateral side of the pawl and including a first corner and a second corner;

the handle including an upper side, the cavity including a vertical portion extending to the upper side of the handle, the switch member including a column rotatably received in the vertical portion of the cavity, the column having a transverse hole that faces the groove of the pawl;

an elastic element mounted in the transverse hole of the column and having an end abutting with an inner peripheral wall defining the vertical portion of the cavity;

a pin having a first end that is received in the transverse hole of the column and that has a receptacle for receiving another end of the elastic element, the pin further having a second end received in the groove of the pawl, the second end of the pin being biased by the elastic element to be selectively, securely engaged in one of the first corner and the second corner of the groove of the pawl that corresponds to said one of the positions of the switch member relative to the handle.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
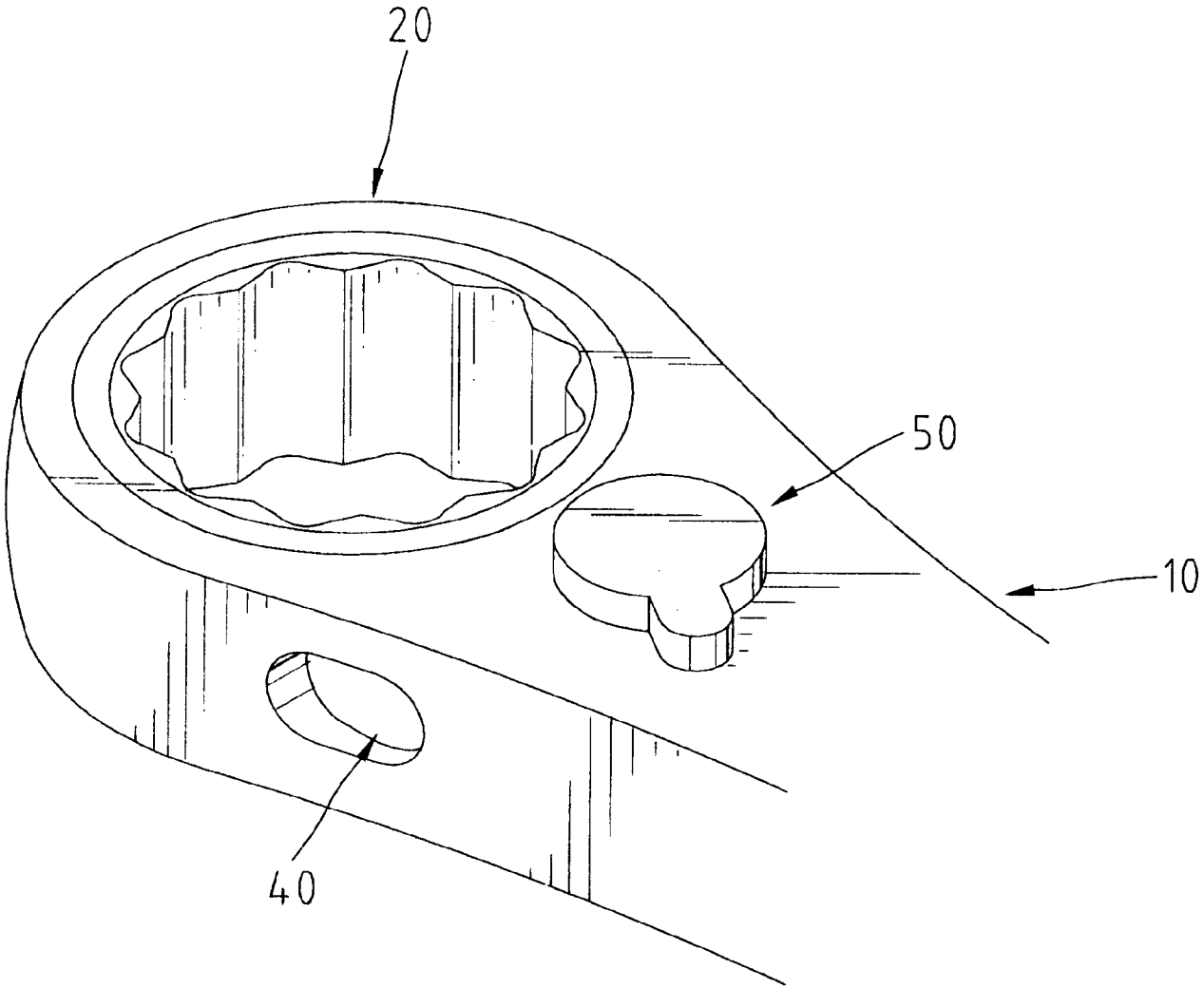
FIG. 1 is a perspective view of a portion of a wrench in accordance with the present invention.
Figure 2:
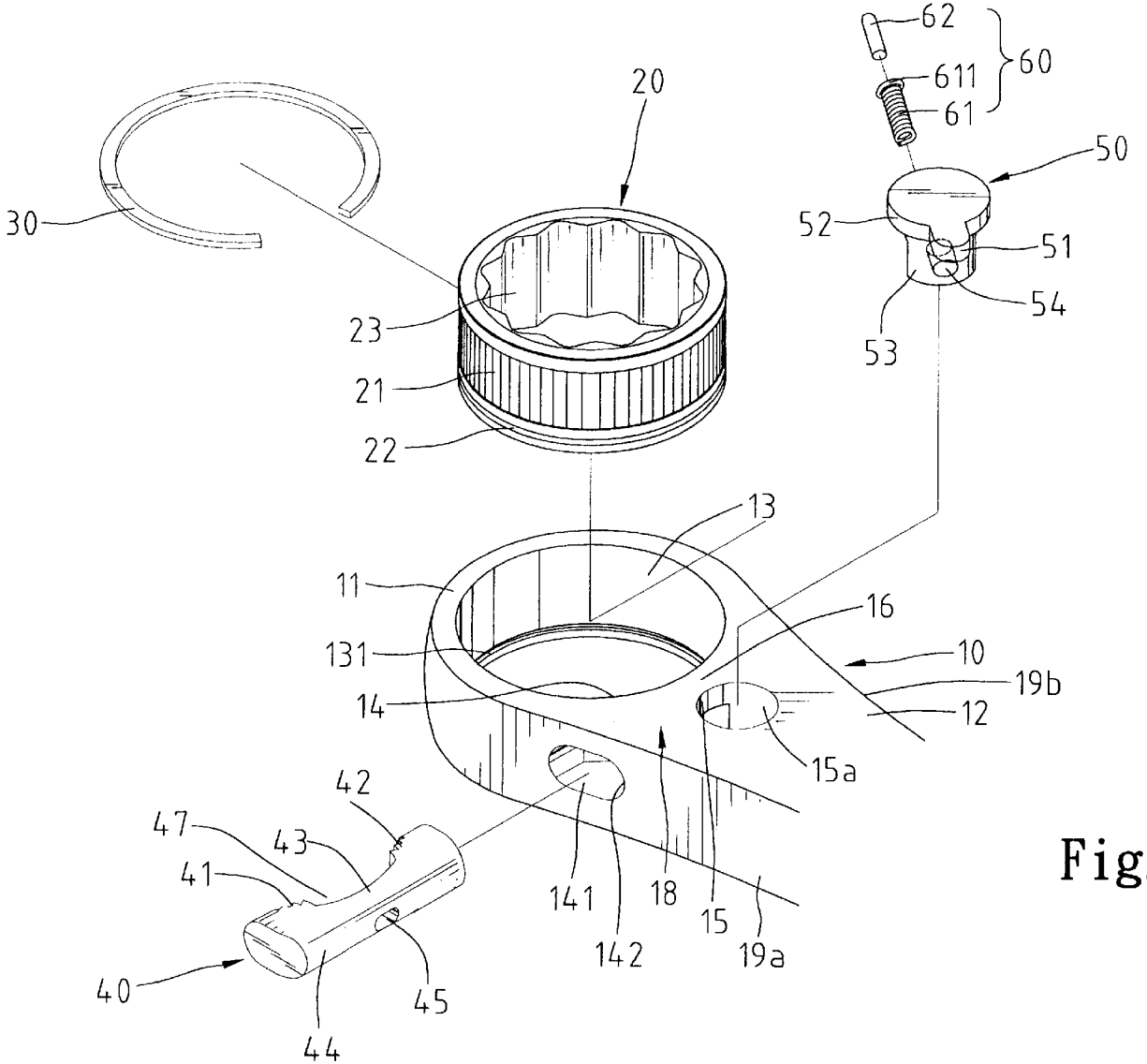
FIG. 2 is an exploded perspective view of the portion of the wrench in FIG. 1.
Figure 3:
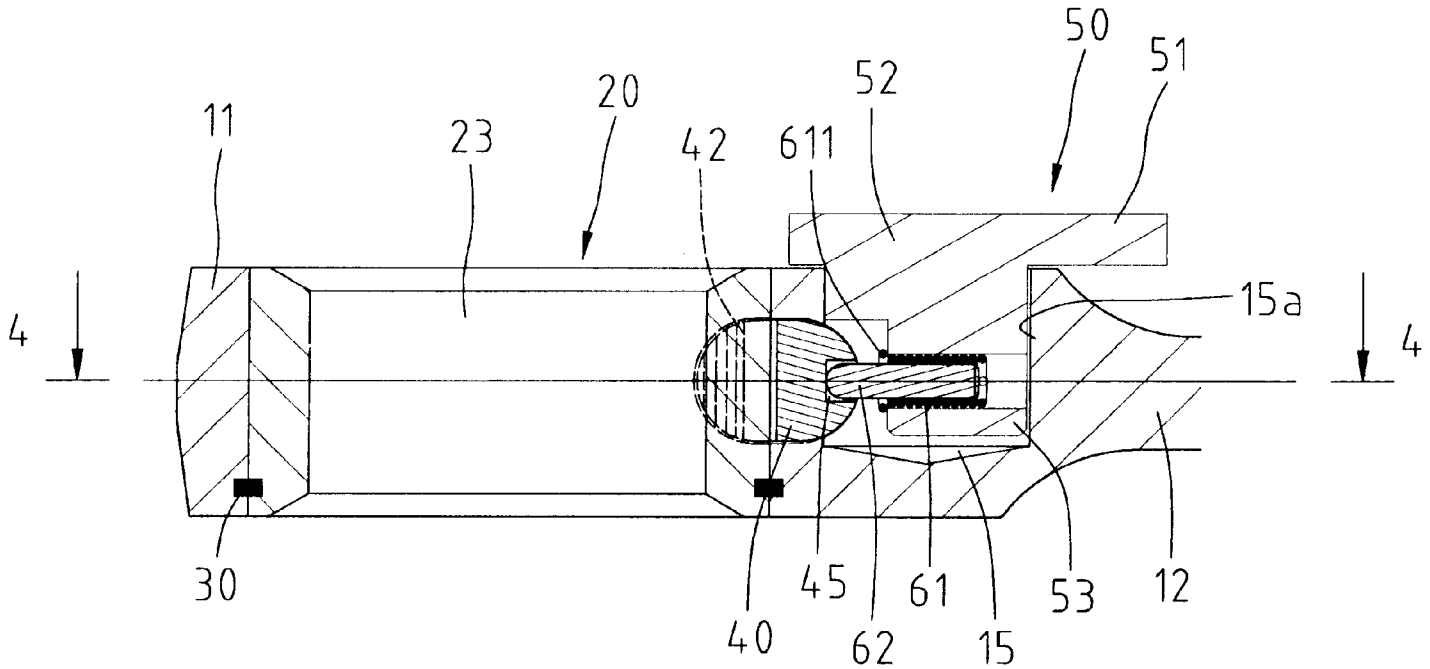
FIG. 3 is a sectional view of the portion of the wrench in FIG. 1.

Referring to FIGS. 1 through 4, a wrench 10 in accordance with the present invention generally includes a handle 12 and a head 11 extended from the handle 12, a web 18 being defined between the handle 12 and the head 11. The head 11 includes a compartment 13. An oval transverse through-hole 14 (FIG. 4) is defined in the web 18 and includes an intermediate portion communicated with the compartment 13. The transverse through-hole 14 extends from one lateral side 19*a* of the handle 12 to the other lateral side 19*b* of the handle 12, thereby defining an opening 141 in each of two ends thereof. The transverse through-hole 14 includes an inner longitudinal wall 142 that faces the compartment 13, which will be described later. The web 18 further includes a cavity 15 defined therein and communicated with the transverse through-hole 14. Referring to FIGS. 2 and 3, the cavity 15 includes a vertical portion 15*a* that extends upward to an upper side of the handle 12. Thus, a bridge 16 is formed on the upper side of the handle 12 and between the compartment 13 and the cavity 15. Namely, the vertical portion 15*a* of the cavity 15 extends from an upper side of the handle 12 toward a bottom side of the handle 12 but spaced from the bottom side. The bridge 16 is delimited by compartment 13 of the head 11 and the cavity 15 (including the vertical portion 15*a*).

A drive member 20 (in the form of a drive gear in this embodiment) is rotatably mounted in the compartment 13. The drive member 20 includes a plurality of teeth 21 on an outer periphery thereof and an annular groove 22 in a lower portion of the outer periphery thereof. A portion of the teeth 21 of the drive member 20 extends into the transverse through-hole 14, best shown in FIG. 4. The drive member 20 further includes a polygonal inner periphery 23 for engaging with a fastener, such as a nut or a bolt head. A C-clip 30 is engaged in the annular groove 22 of the drive member 20 and an annular groove 131 (FIG. 2) defined in a lower portion of an inner periphery defining the compartment 13, thereby rotatably mounting the drive member 20 in the compartment 13, best shown in FIG. 3.

Figure 4:
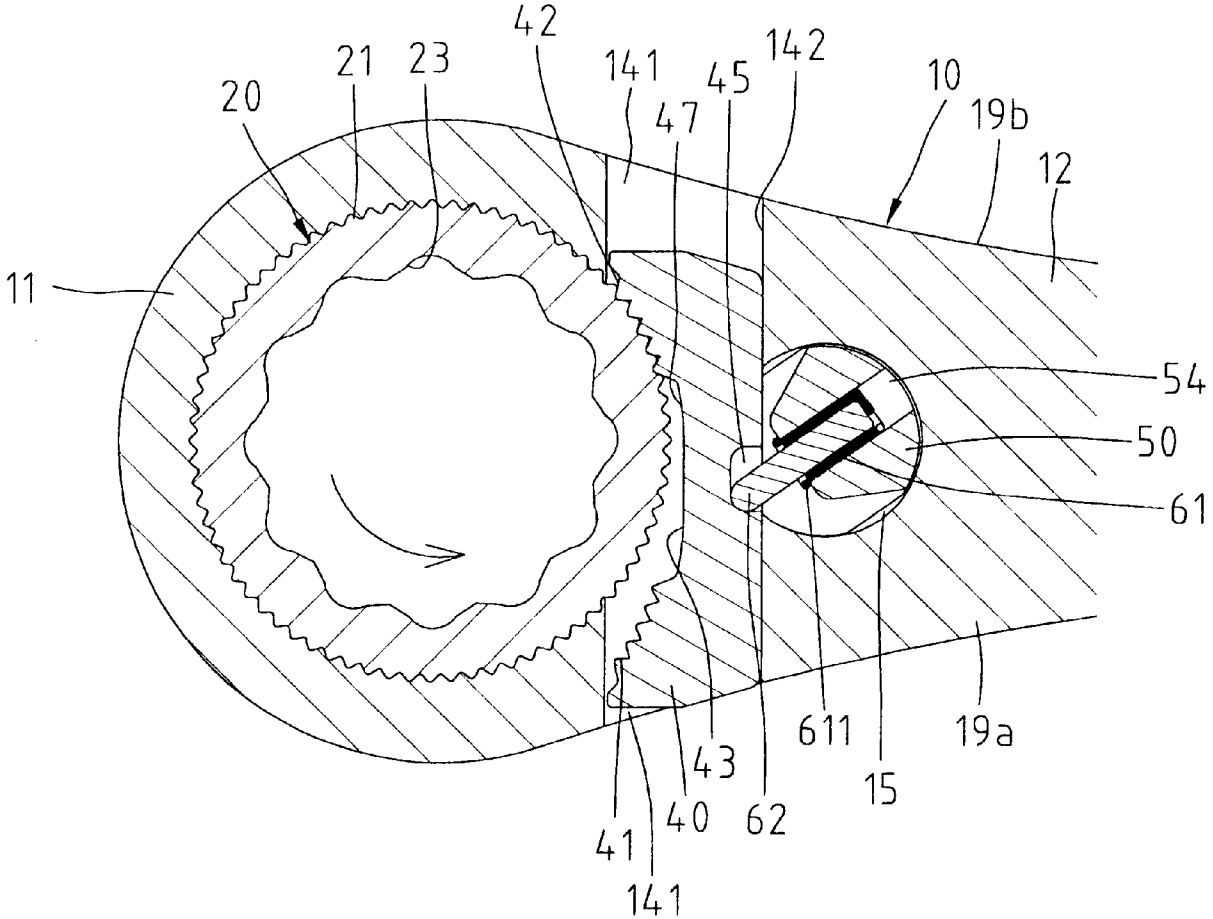
FIG. 4 is a sectional view taken along line 4—4 in FIG. 3.

An elongated pawl 40 with two oval end portions is mounted in the transverse through-hole 14 and slideable along a lengthwise direction of the transverse through-hole 14. The pawl 40 includes a first lateral side 47 facing the drive member 20 and a second lateral side 44 facing away from the drive member 20. As illustrated in FIG. 4, the first lateral side 47 of the pawl 40 is preferably arcuate and includes a first toothed portion 41, a second toothed portion 42, and a recessed portion 43 between the first toothed portion 41 and the second toothed portion 42. The pawl 40 further includes a groove 45 in an intermediate portion of the second lateral side 44 thereof.

A switch member 50 is rotatably mounted in the vertical portion 15*a* of the cavity 15. In this embodiment, the switch member 50 includes an enlarged head 52 larger than a diameter of the vertical portion 15*a* of the cavity 15, a thumb piece 51 extended radially outward from the enlarged head 52 for easy manual operation by a user, and a column 53 including a transverse through-hole 54, best shown in FIGS. 3 and 4.

Referring to FIGS. 2 through 4, a biasing means 60 comprises an elastic element 61 (in the form of a coil spring) mounted in the transverse hole 54 of the column 53 and having an enlarged portion 611 abutting against an outer periphery of the column 53 and surrounding the transverse hole 54 of the column 53. The biasing means 60 further comprises a pin 62 having a first end received in the elastic element 61 and a second end received in the groove 45 of the pawl 40.

In assembly, the column 53 of the switch member 50 is mounted into the vertical portion 15*a* of the cavity 15 and the elastic element 61 is mounted into the transverse hole 54 of the column 53 with the enlarged portion 611 abutting against the outer periphery of the column 53. The first end of the pin 62 is then mounted into the coil spring 61 and the pawl 40 is inserted into the transverse through-hole 14 of the web 18 via an opening 141 of the transverse through-hole 14. The first lateral side 47 of the pawl 40 faces the compartment 13. Next, the second end of the pin 62 is inserted into the groove 45 of the pawl 40. Then, the C-clip 30 is mounted into the annular groove 22 of the drive member 20, which is then mounted into the compartment 13 of the head 11. The C-clip 30 expands outward into the annular groove 131 of the head 11, thereby rotatably mounting the drive member 20 in the compartment 13. It is noted that the assembly procedure can be accomplished easily and quickly without any screws or covers.

In use, referring to FIG. 4, when the second end of the pin 62 is engaged in a corner of the groove 45 of the pawl 40, the pin 62 exerts a force to the pawl 40 under the action of the coil spring 61. The force can be imparted into a horizontal force parallel to the lengthwise direction of the pawl 40 and a vertical force that is normal to the horizontal force. If the handle 12 is turned counterclockwise, the drive member 20 is firmly engaged with the second toothed portion 42 of the pawl 40 under the action of the vertical force, thereby tightening or loosening the fastener (not shown) engaged in the polygonal inner periphery 23 of the drive member 20. A higher torque is provided, as the drive member 20 is firmly engaged with and in intimate contact with the second toothed portion 42 of the pawl 40. In addition, the force transmitted to the pawl 40 from the drive member 20 is distributed to the inner longitudinal wall 142 of the transverse through-hole 14 having a relatively large area. As a result, the wrench in accordance with the present invention may bear higher torque. The drive member 20 rotates freely when the handle 12 is turned clockwise. It is noted that the pawl 40 will not protrude beyond the transverse through-hole 14 during operation. Inadvertent switching in the ratcheting direction is avoided.

Figure 5:
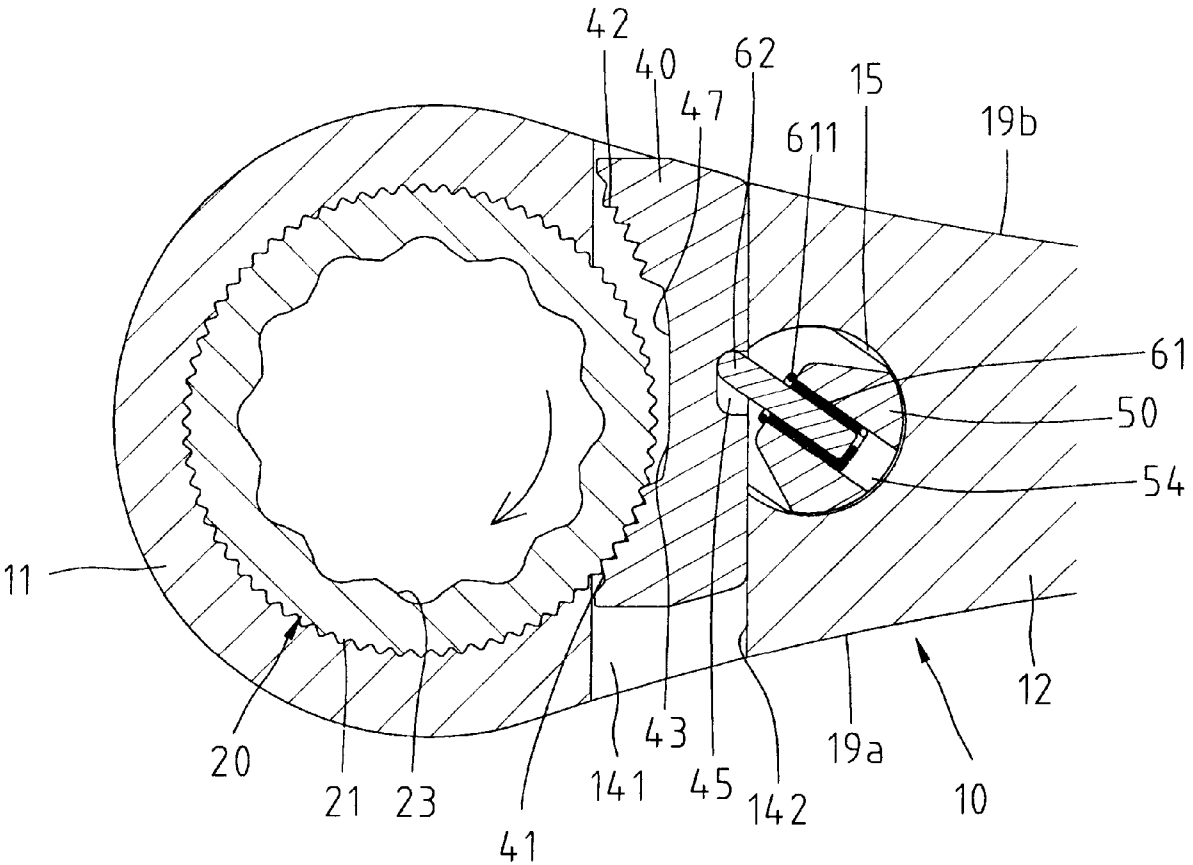
FIG. 5 is a view similar to FIG. 4, wherein the switch member is in a position for ratcheting in a reverse direction.
Figure 6:
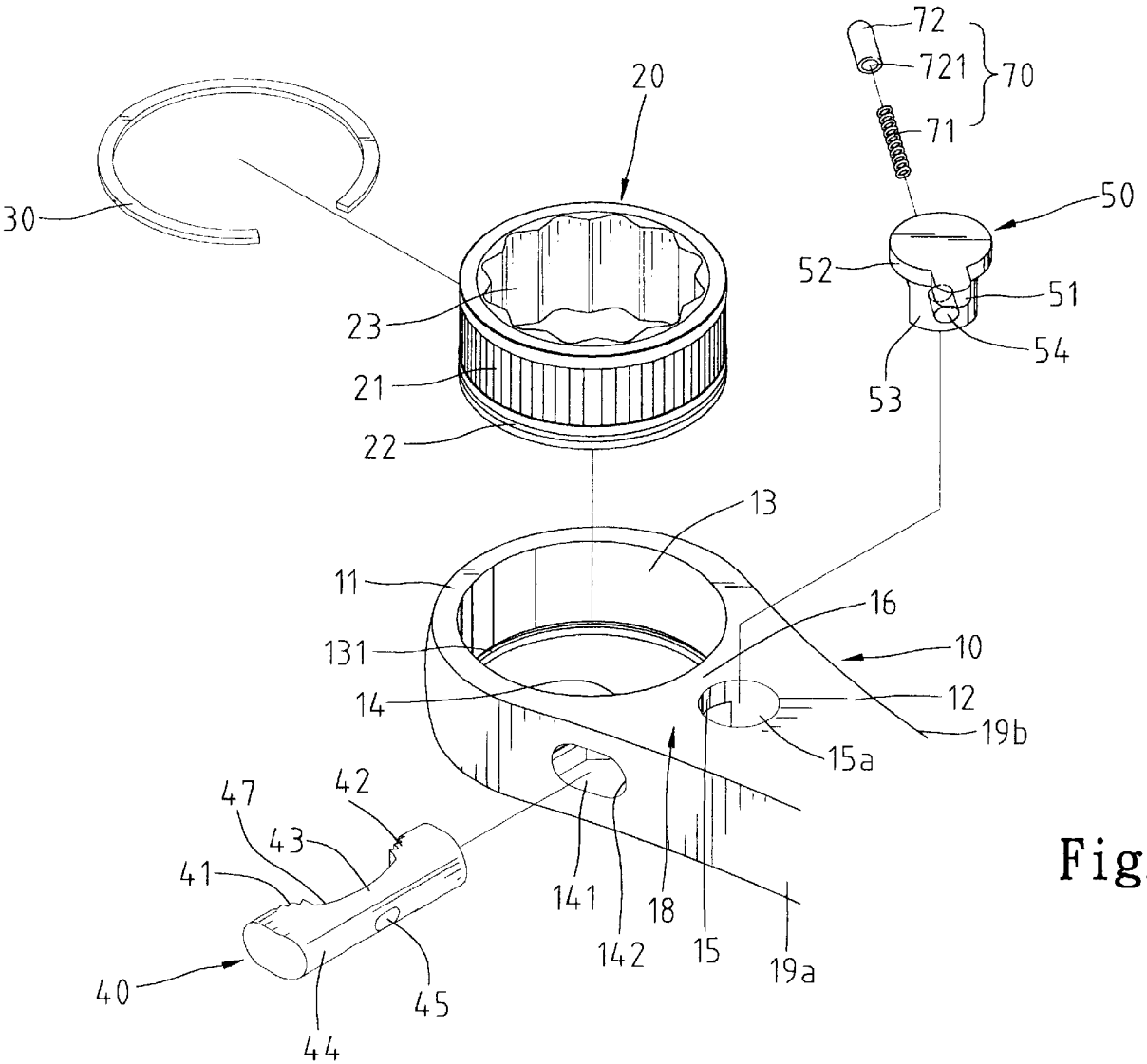
FIG. 6 is an exploded perspective view of a portion of a modified embodiment of the wrench in accordance with the present invention.
Figure 7:
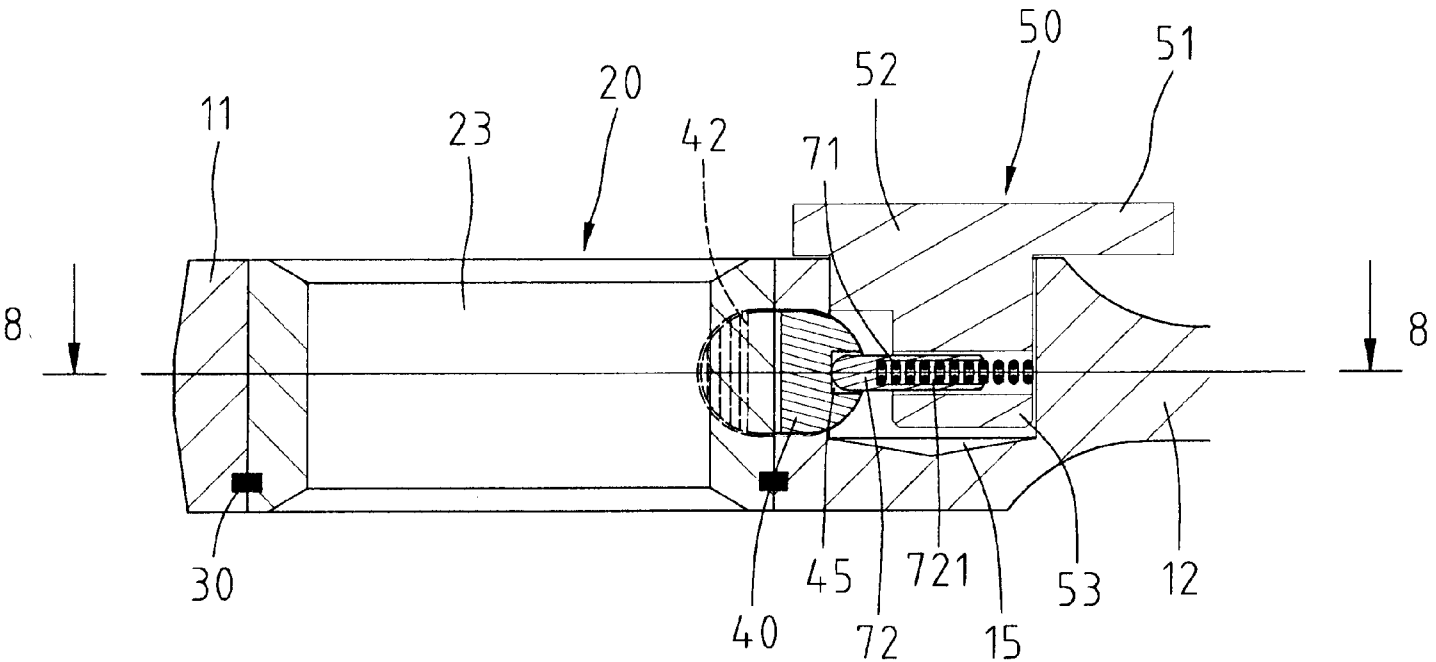
FIG. 7 is a sectional view of the portion of the wrench in FIG. 6.
Figure 8:
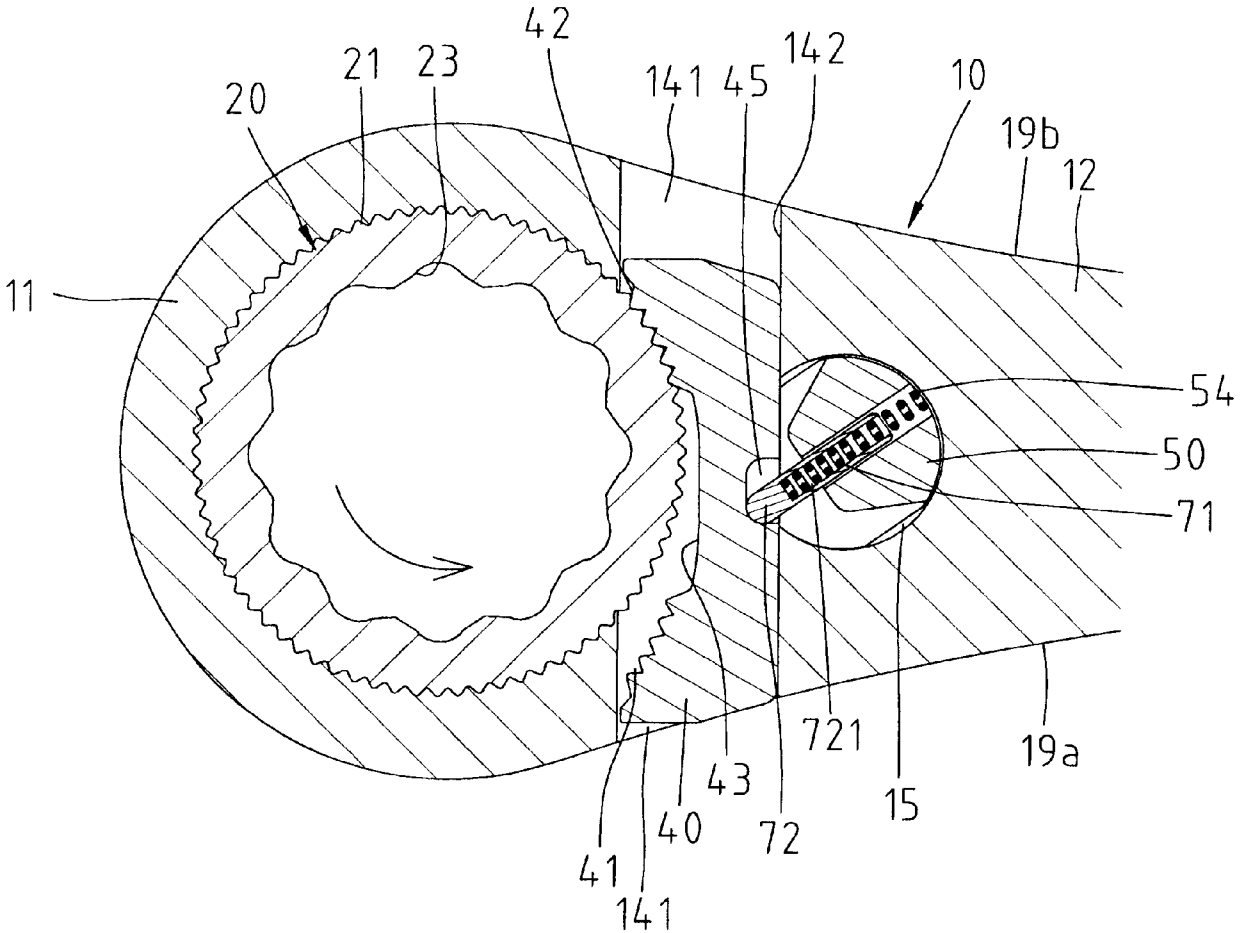
FIG. 8 is a sectional view taken along line 8—8 in FIG. 7
Figure 9:
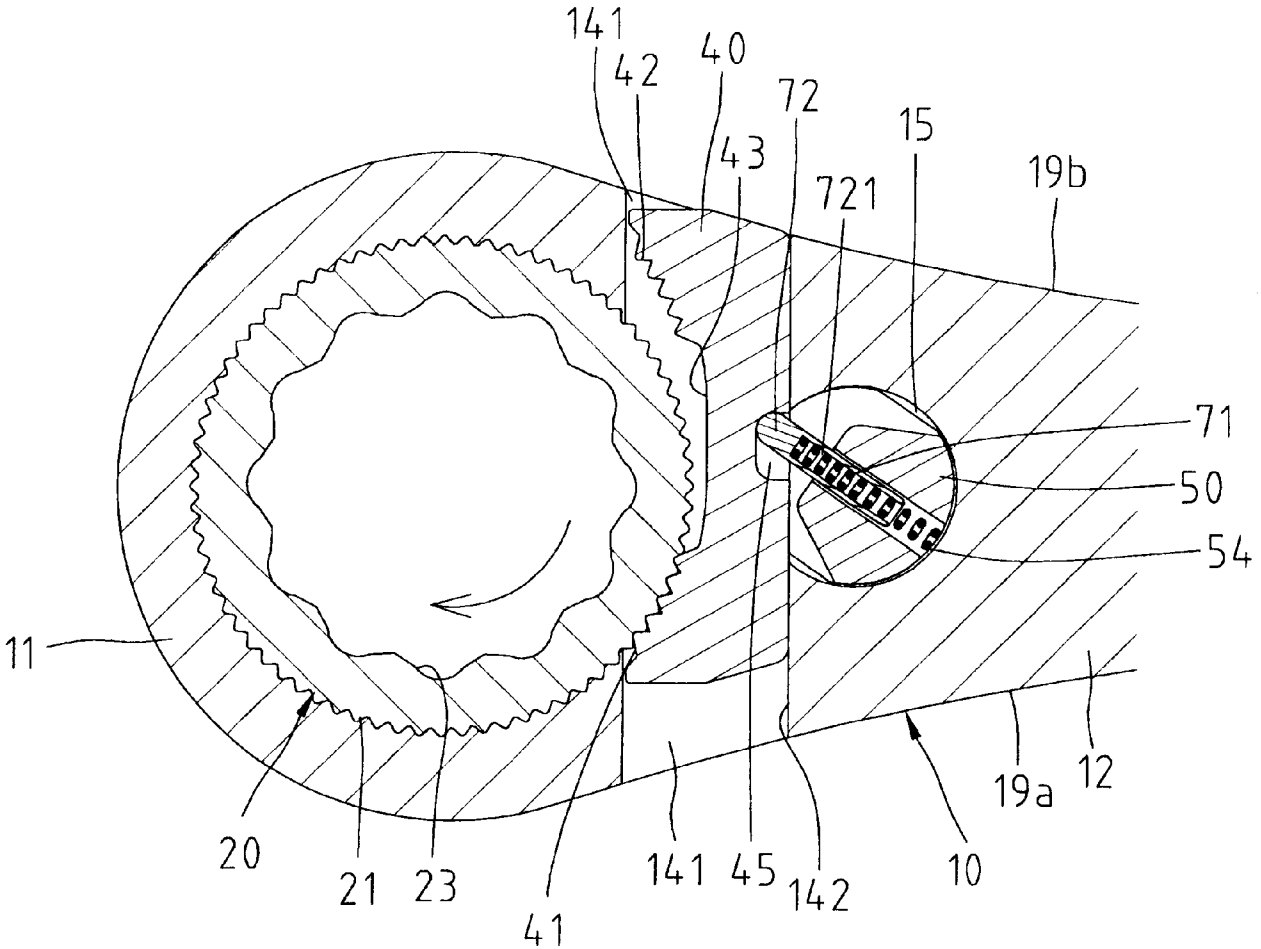
FIG. 9 is a sectional view similar to FIG. 8, wherein the switch member is in a position for ratcheting in a reverse direction.
Figure 10:
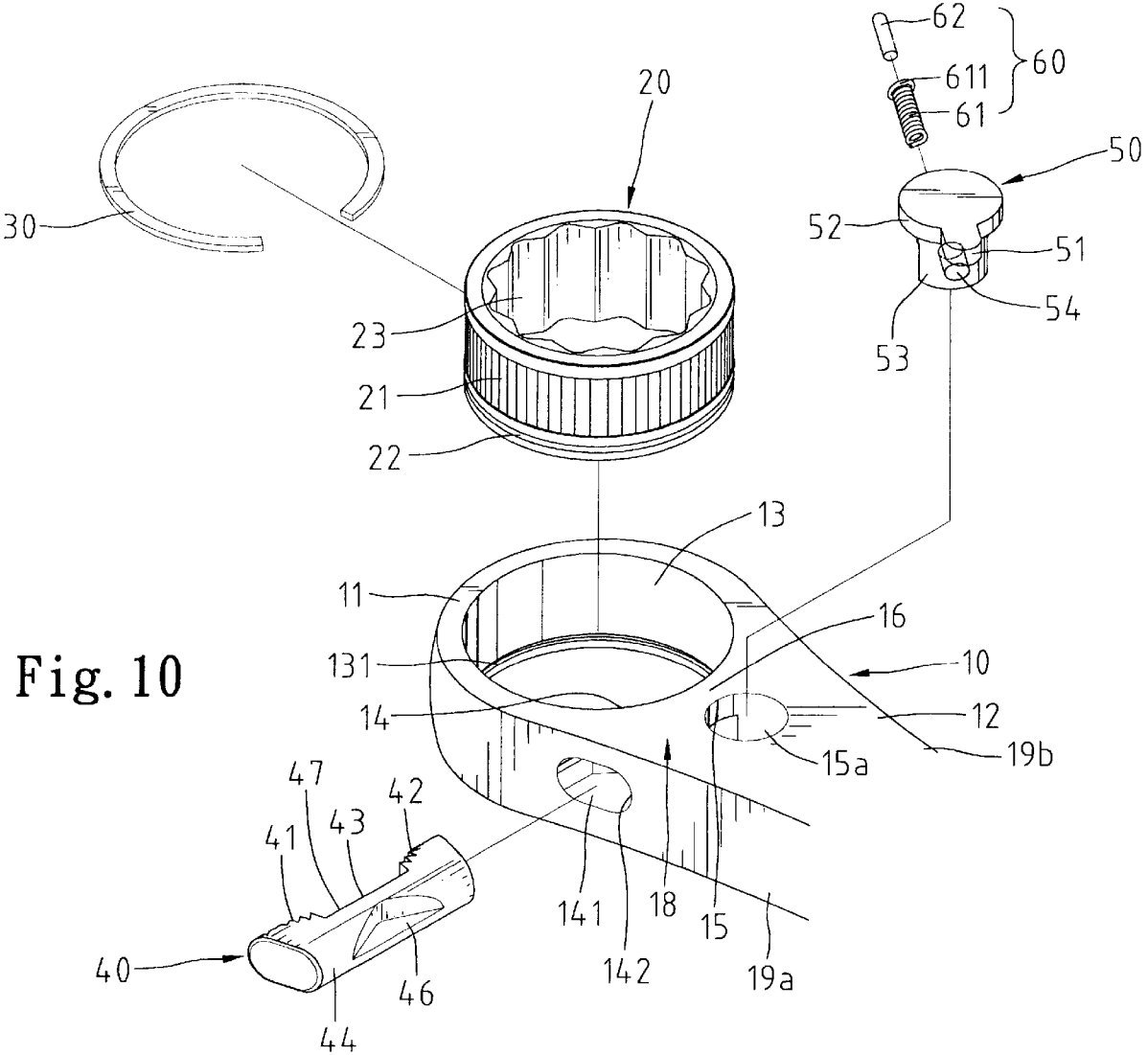
FIG. 10 is an exploded perspective view of a portion of a further modified embodiment of the wrench in accordance with the present invention.

Referring to FIG. 5, the switch member 50 is pivoted through an angle, and the pawl 40 in the transverse through-hole 14 is moved to another position. The second end of the pin 62 is now engaged in another corner of the groove 45 of the pawl 40. The pin 62 exerts a force to the pawl 40 under the action of the coil spring 61. The force can be imparted into a horizontal force parallel to the lengthwise direction of the pawl 40 and a vertical force that is normal to the horizontal force. If the handle 12 is turned clockwise, the drive member 20 is firmly engaged with the first toothed portion 41 of the pawl 40 under the action of the vertical force, thereby tightening or loosening the fastener engaged in the polygonal inner periphery 23 of the driver member 20. Again, a higher torque is provided, as the drive member 20 is firmly engaged with and in intimate contact with the first toothed portion 41 of the pawl 40. In addition, the force transmitted to the pawl 40 from the drive member 20 is distributed to the inner longitudinal wall 142 of the transverse through-hole 14 having a relatively large area. As a result, the wrench in accordance with the present invention may bear higher torque. The drive member 20 rotates freely when the handle 12 is turned counterclockwise. It is noted that the pawl 40 will not protrude beyond the transverse through-hole 14 during operation. Inadvertent switching in the ratcheting direction is avoided.

In the first-mentioned embodiment, the assembly procedure can be achieved easily and quickly by means of a C-clip 30, no screw or cover is required. In addition, the switch member 50 can be retained in place without any other retaining device.

FIGS. 6 through 9 illustrate a modified embodiment of the wrench in accordance with the present invention, the difference between this embodiment and the first embodiment is the biasing means 70. In this embodiment, the biasing means 70 comprises an elastic element 71 mounted in the transverse hole 54 of the column 53 and having an end attached to an inner peripheral wall defining the vertical portion 15*a* of the cavity 15. The biasing means 70 further comprises a pin 72 having a first end that is received in the transverse hole 54 of the column 53 and that has a receptacle 721 for receiving the other end of the elastic element 71. The pin 72 further has a second end received in the groove 45 of the pawl 40. Other structure and operation of the wrench are identical to those of the first embodiment.

Figure 11:
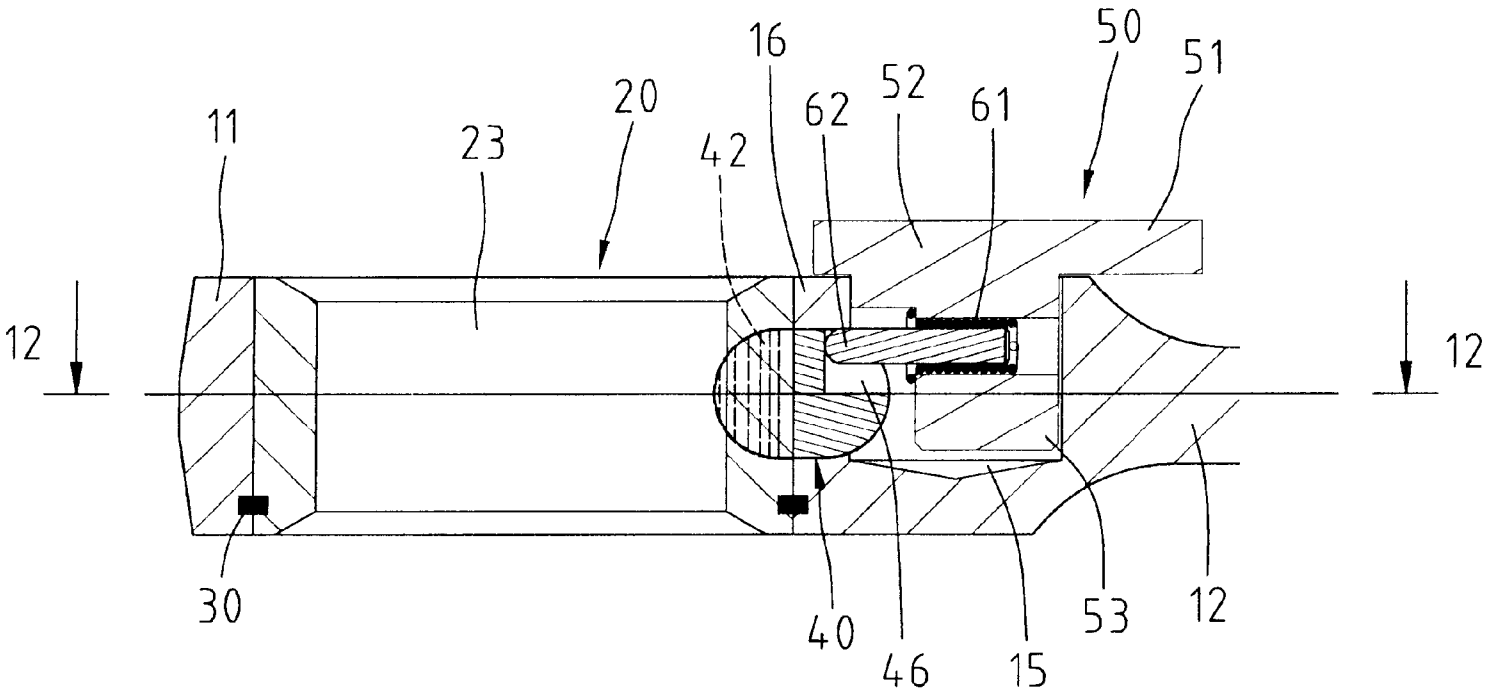
FIG. 11 is a sectional view of the portion of the wrench in FIG. 10.
Figure 12:
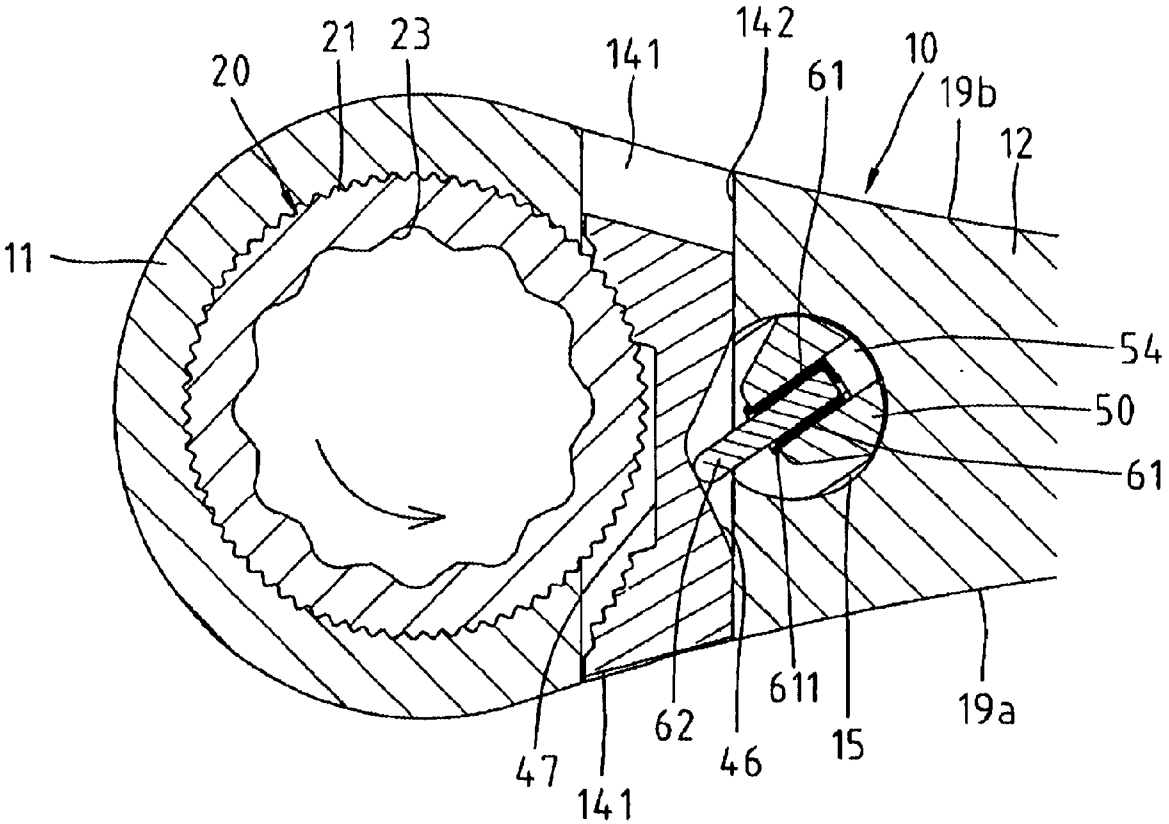
FIG. 12 is a sectional view taken along line 12—12 in FIG. 11.
Figure 13:
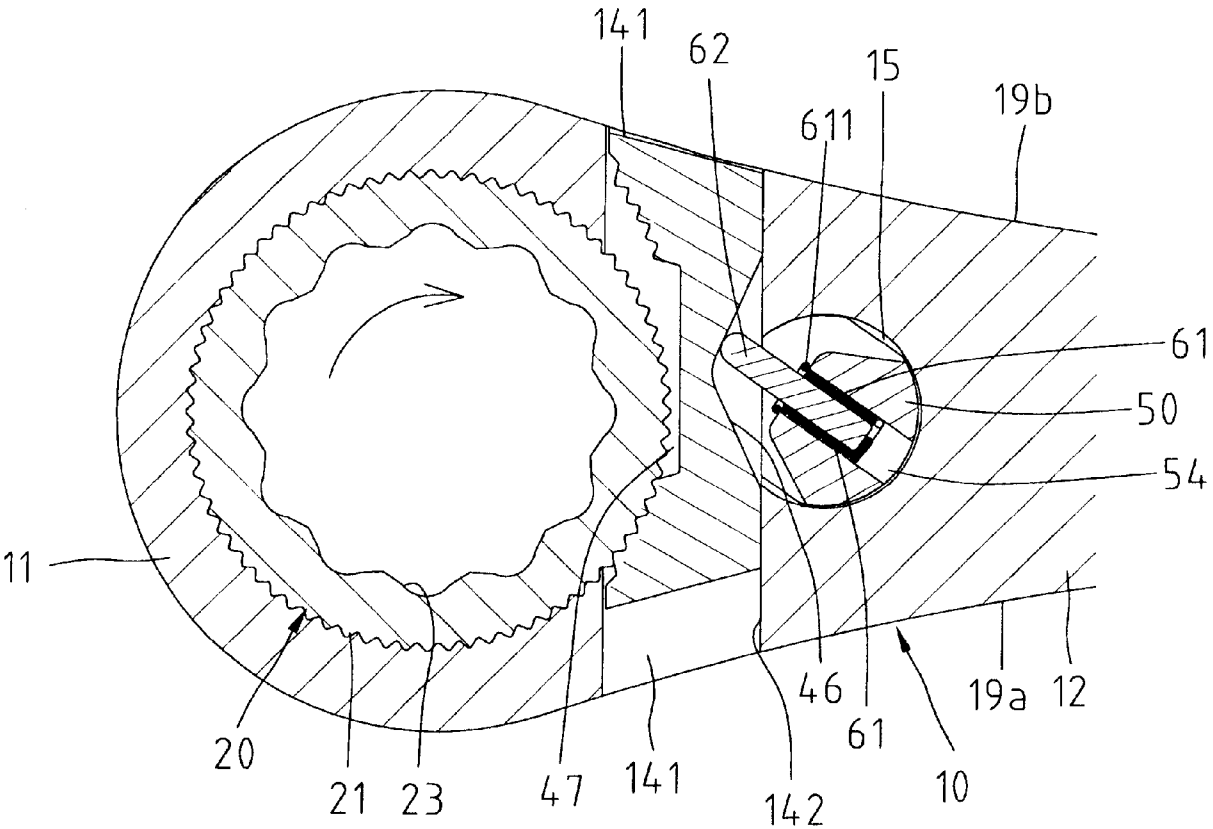
FIG. 13 is a sectional view similar to FIG. 12, wherein the switch member is in a position for ratcheting in a reverse direction.
Figure 14:
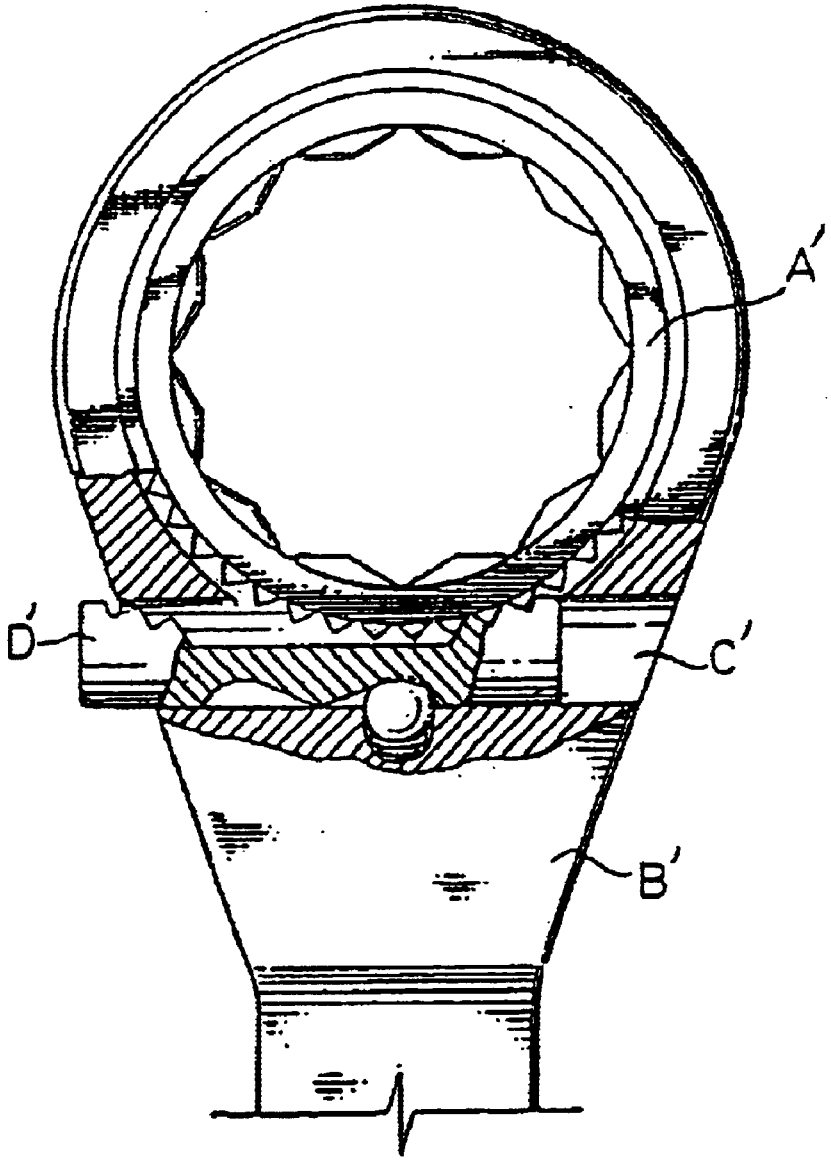
Fig. 14 PRIOR ART
FIG. 14 is a top view, partly sectioned, of a portion of a conventional wrench.
Figure 15:
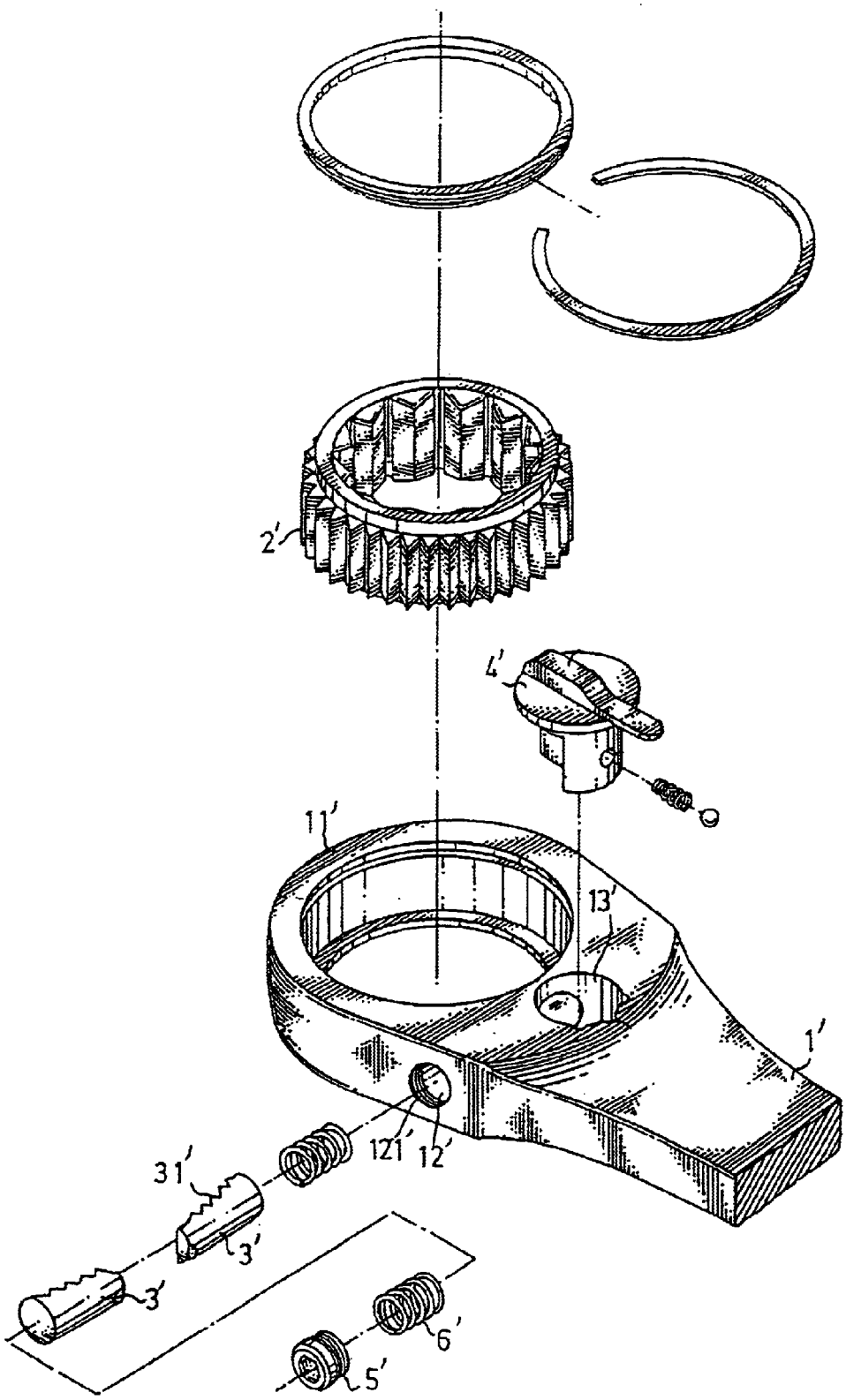
Fig. 15 PRIOR ART
FIG. 15 is an exploded view of a portion of another conventional wrench.
Figure 16:
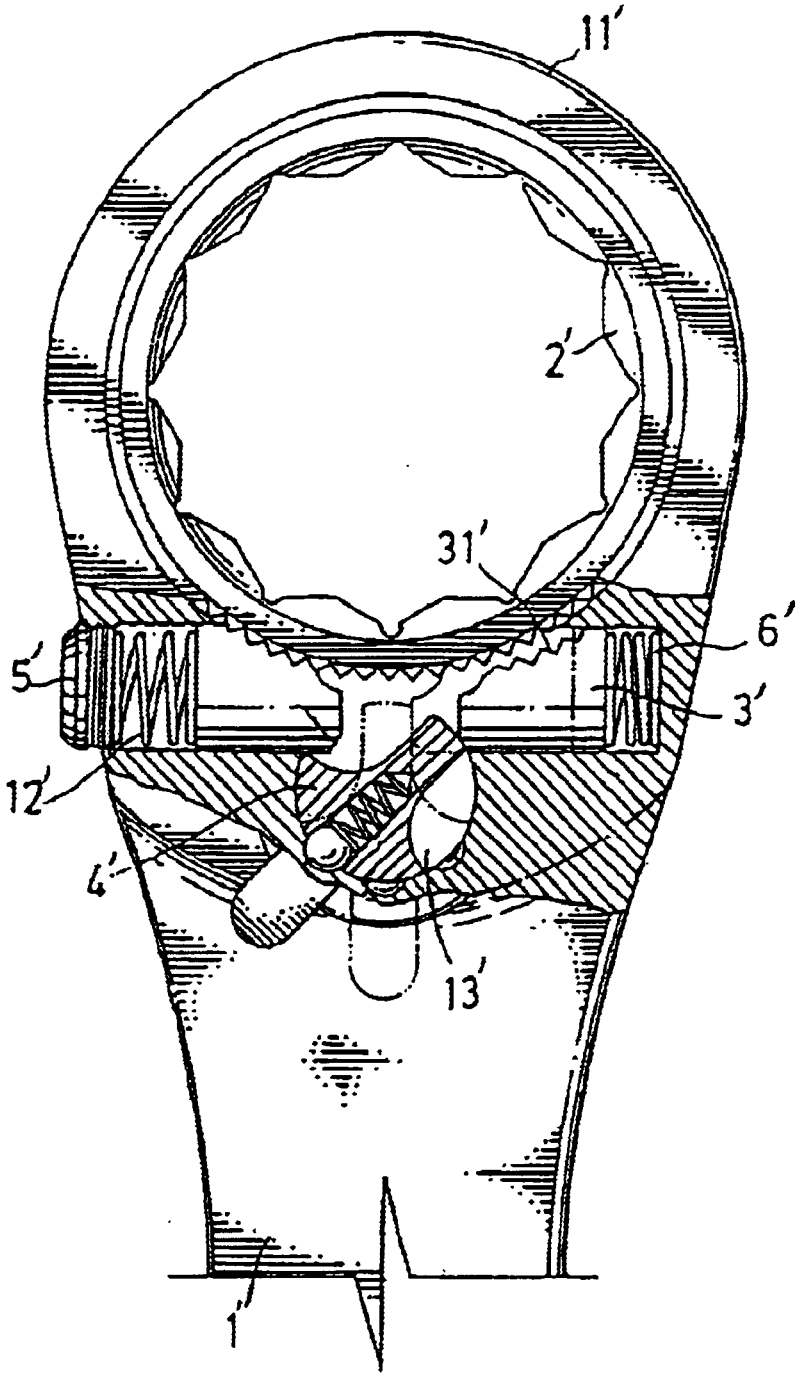
Fig. 16 PRIOR ART
FIG. 16 is a top view, partly sectioned, of the portion of the conventional wrench in FIG. 15.
Figure 17:
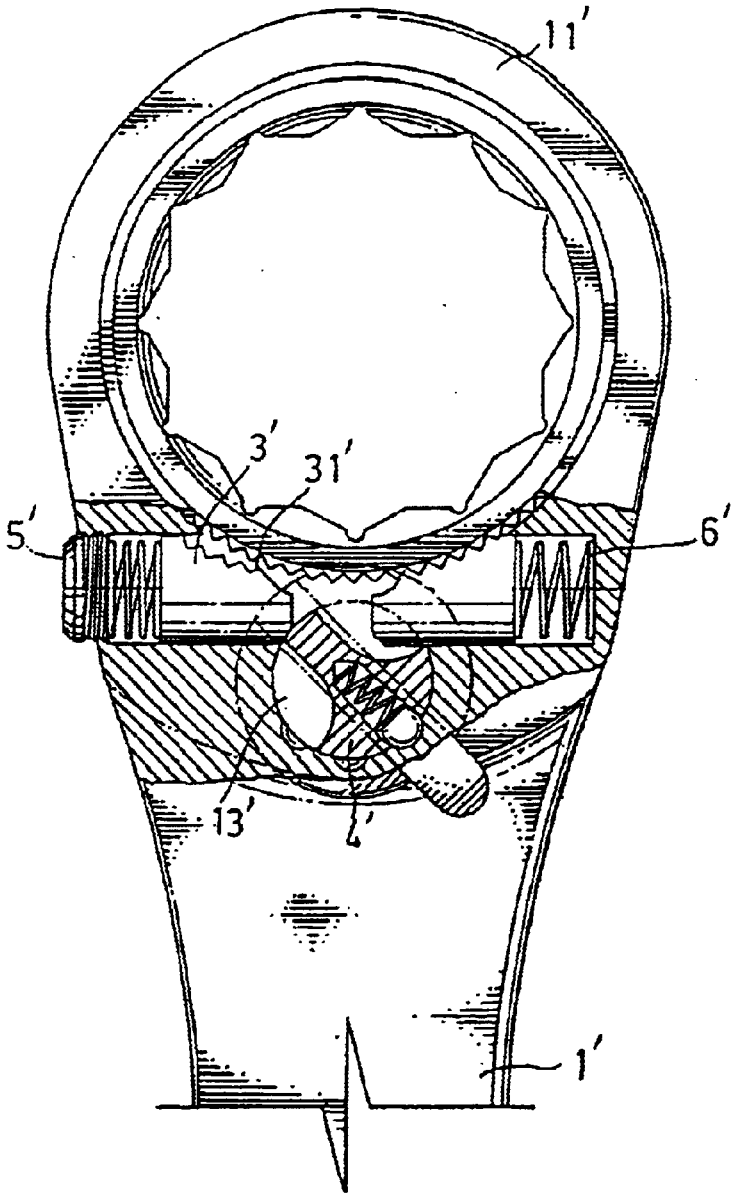
Fig. 17 PRIOR ART
FIG. 17 is a view similar to FIG. 16, wherein the switch member of the wrench is in a position for ratcheting in a reverse direction.
Figure 18:
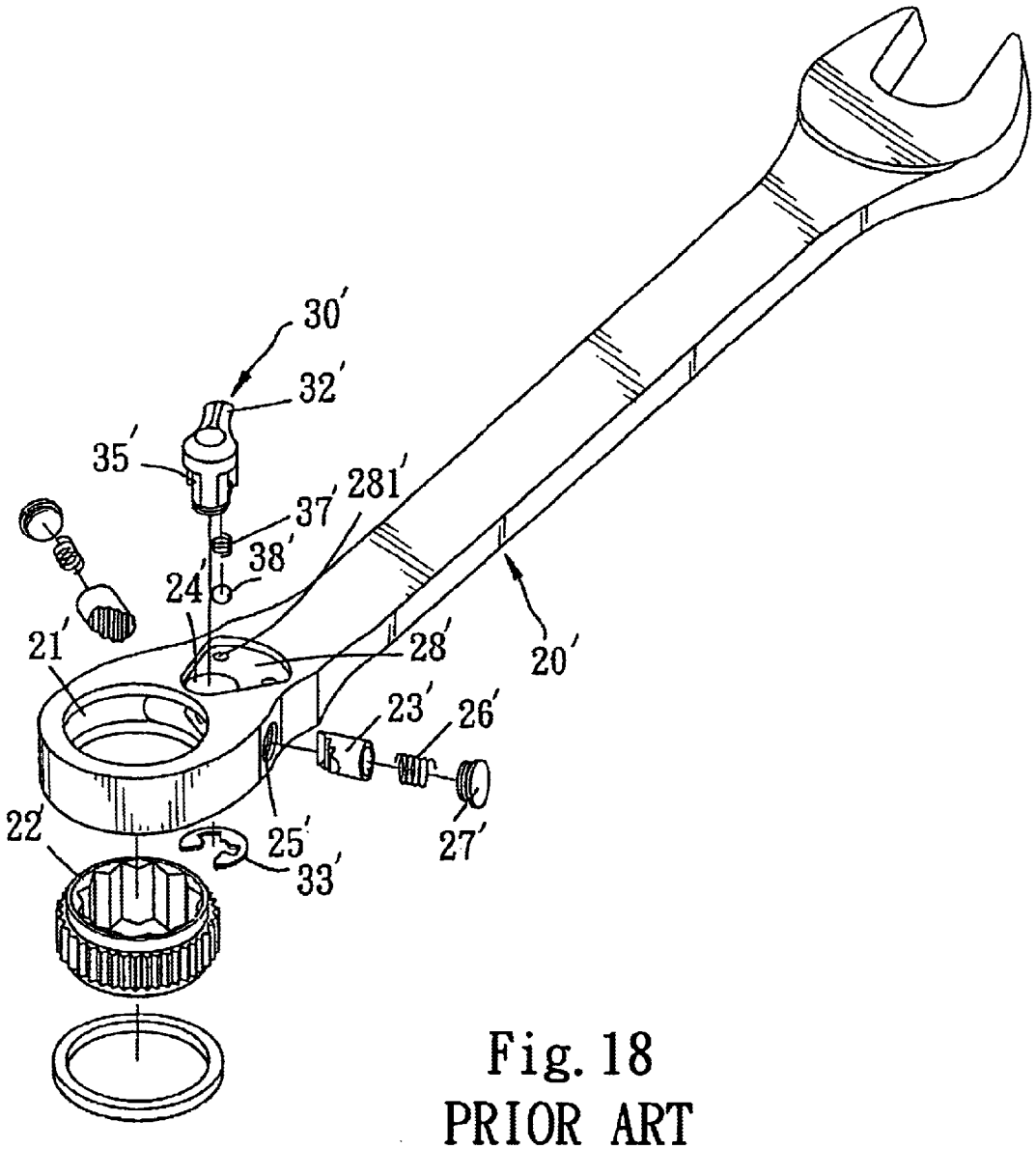
Fig. 18 PRIOR ART
FIG. 18 is an exploded perspective view of a further conventional wrench.
Figure 19:
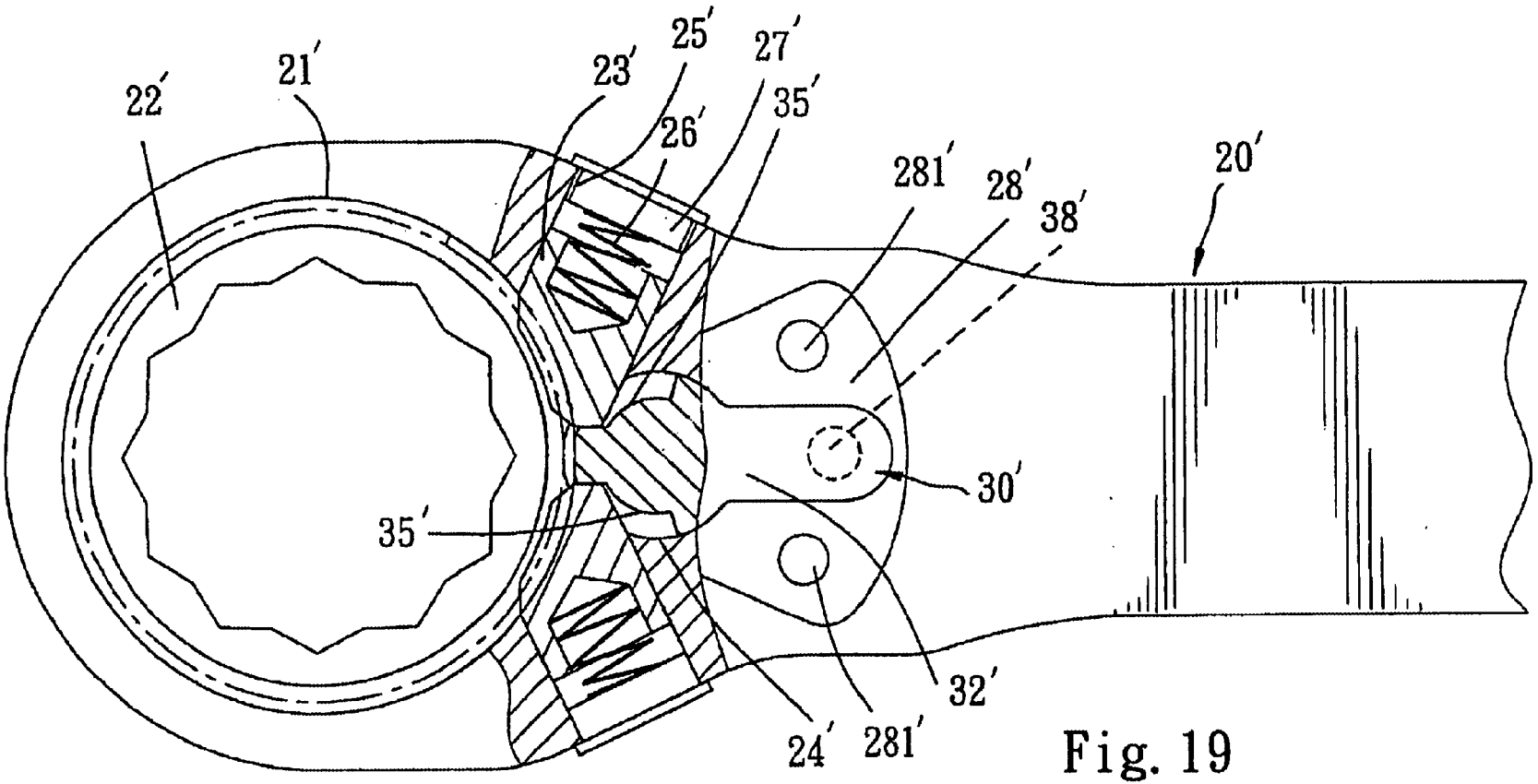
Fig. 19 PRIOR ART
FIG. 19 is a top view, partly sectioned, of a portion of the conventional wrench in FIG. 18.
Figure 20:
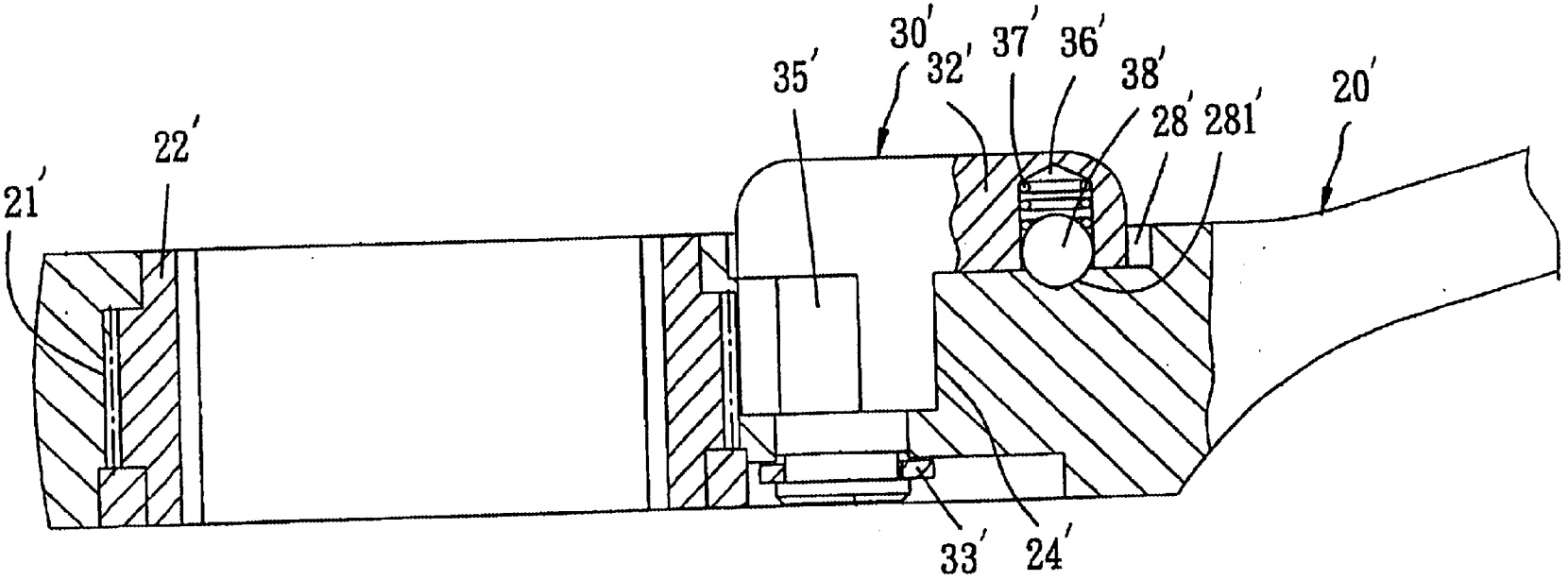
Fig. 20 PRIOR ART
FIG. 20 is a side view, partly sectioned, of the portion of the conventional wrench in FIG. 18.

FIGS. 10 through 13 illustrate another embodiment modified from the first embodiment. The difference between this embodiment and the first embodiment is that the second lateral side 44 of the pawl 40 has a groove 46 for replacing the groove 45. In this embodiment, the groove 46 is substantially triangular and has an open upper side. Thus, as illustrated in FIG. 11, the second end of the pin 62 of the biasing means 60 bears against a bottom edge of the bridge 16. This prevents disengagement of the switch member 50 from the cavity 15. Other structure and operation of the wrench are identical to those of the first embodiment.

According to the above description, it is appreciated that the wrenches in accordance with the present invention have simple structures and are easy to assemble by using a C-clip without the need of any screws. In addition, the compartment 13, the transverse through-hole 14, and the cavity 15 can be processed by means of milling. No computer lathe is required. Thus, the cost is low, the manufacture process is short, and the production time is also short. Furthermore, the pawl 40 will not protrude beyond the transverse through-hole 14 during operation. Inadvertent switching of the ratcheting direction is avoided. Further, the drive member 20 is firmly engaged with and in intimate contact with the associated toothed portion 41, 42 of the pawl 40 during ratcheting. The risk of slippage or so-called "teeth jump" is avoided. The second side 44 of the pawl 40 contacts with the inner longitudinal wall 142 of the transverse through-hole 14 by a larger area such that the wrench in accordance with the present invention may bear a higher torque. This also prevents inadvertent relative displacement between the biasing means 60, 70 and the pawl 40. Further, a bridge 16 is provided between the compartment 13 and the cavity 15, which increases the strength of the wrench, thereby providing a higher torque-bearing capacity. The transverse hole 54 in the column 53 of the switch member 50 is preferably a through-hole to allow easy assembly of the biasing means 60, 70. It is appreciated that the transverse hole 54 in the column of the switch member 50 in the second embodiment can be a blind hole and the first end of the elastic element 71 is securely attached to an inner wall defining the transverse hole 54.

Although the invention has been explained in relation to its preferred embodiment, it is to be understood that many other possible modifications and variations can be made without departing from the scope of the invention as hereinafter claimed.

What is claimed is:

1. A wrench comprising:

a handle comprising a first lateral side and a second lateral side opposite to the first lateral side;

a head extended from the handle, a web being defined between the handle and the head, the head including a compartment, the web including a transverse hole having an intermediate portion communicated with the compartment, the transverse hole of the web extending from the first lateral side and between the first lateral side and the second lateral side of the handle, a cavity being defined in the web and communicated with the transverse hole of the web;

a drive member rotatably mounted in the compartment of the head and including a plurality of teeth on an outer periphery thereof;

a switch member mounted in the cavity and rotatable relative to the handle between two positions corresponding to two opposite ratcheting directions of the handle; and a pawl mounted in the transverse hole and slideable along a lengthwise direction of the transverse hole, the pawl including a first lateral side facing the compartment and a second lateral side facing away from the compartment, the first lateral side of the pawl including a first toothed portion and a second toothed portion that are selectively engaged with the teeth of the drive member according to one of the positions of the switch member relative to the handle, a groove being defined in the second lateral side of the pawl and including a first corner and a second corner;

the handle including an upper side, the cavity including a vertical portion extending to the upper side of the handle, the switch member including a column rotatably received in the vertical portion of the cavity, the column having a transverse hole that faces the groove of the pawl;

a coil spring mounted in the transverse hole of the column and having an enlarged portion abutting against an outer periphery of the column and surrounding the transverse hole of the column; and a pin having a first end received in the coil spring and a second end received in the groove of the pawl, the second end of the pin being biased by the coil spring to be selectively, securely engaged in one of the first corner and the second corner of the groove of the pawl that corresponds to said one of the positions of the switch member relative to the handle.

2. The wrench as claimed in claim 1, wherein an inner periphery defining the compartment includes an annular groove in a lower end thereof; the outer periphery of the drive member including an annular groove in a lower end thereof, with the wrench further comprising a C-clip engaged in the annular groove of the compartment and the annular groove of the drive member, thereby rotatably mounting the drive member in the compartment.

3. The wrench as claimed in claim 1, wherein the transverse hole of the column of the switch member is a through-hole.

4. The wrench as claimed in claim 2, wherein the transverse hole of the column of the switch member is a through-hole.

5. The wrench as claimed in claim 1, wherein the groove of the pawl is triangular and includes an open upper side, the compartment of the head and the cavity of the web together delimiting a bridge, with the second end of the pin abutting against a bottom side of the bridge.

6. The wrench as claimed in claim 2, wherein the groove of the pawl is triangular and includes an open upper side, the compartment of the head and the cavity of the web together delimiting a bridge, with the second end of the pin abutting against a bottom side of the bridge.

7. The wrench as claimed in claim 3, wherein the groove of the pawl is triangular and includes an open upper side, the compartment of the head and the cavity of the web together delimiting a bridge, with the second end of the pin abutting against a bottom side of the bridge.

8. The wrench as claimed in claim 4, wherein the groove of the pawl is triangular and includes an open upper side, the compartment of the head and the cavity of the web together delimiting a bridge, with the second end of the pin abutting against a bottom side of the bridge.

9. The wrench as claimed in claim 1, wherein the switch member comprises an enlarged head located outside the vertical portion of the cavity and extended from the column, a thumb piece extending radially outward from the enlarged head for manual operation by a user to move the switch member between the two positions.

10. The wrench as claimed in claim 2, wherein the switch member comprises an enlarged head located outside the vertical portion of the cavity and extended from the column, a thumb piece extending radially outward from the enlarged head for manual operation by a user to move the switch member between the two positions.

11. The wrench as claimed in claim 3, wherein the switch member comprises an enlarged head located outside the vertical portion of the cavity and extended from the column, a thumb piece extending radially outward from the enlarged head for manual operation by a user to move the switch member between the two positions.

12. The wrench as claimed in claim 5, wherein the switch member comprises an enlarged head located outside the vertical portion of the cavity and extended from the column, a thumb piece extending radially outward from the enlarged head for manual operation by a user to move the switch member between the two positions.

13. A wrench comprising:

a handle comprising a first lateral side and a second lateral side opposite to the first lateral side;

a head extended from the handle, a web being defined between the handle and the head, the head including a compartment, the web including a transverse hole having an intermediate portion communicated with the compartment, the transverse hole of the web extending from the first lateral side and between the first lateral side and the second lateral side of the handle, a cavity being defined in the web and communicated with the transverse hole of the web;

a drive member rotatably mounted in the compartment of the head and including a plurality of teeth on an outer periphery thereof;

a switch member mounted in the cavity and rotatable relative to the handle between two positions corresponding to two opposite ratcheting directions of the handle; and a pawl mounted in the transverse hole and slideable along a lengthwise direction of the transverse hole of the web, the pawl including a first lateral side facing the compartment and a second lateral side facing away from the compartment, the first lateral side of the pawl including a first toothed portion and a second toothed portion that are selectively engaged with the teeth of the drive member according to one of the positions of the switch member relative to the handle, a groove being defined in the second lateral side of the pawl and including a first corner and a second corner;

the handle including an upper side, the cavity including a vertical portion extending to the upper side of the handle, the switch member including a column rotatably received in the vertical portion of the cavity, the column having a transverse hole that faces the groove of the pawl;

an elastic element mounted in the transverse hole of the column and having an end;

a pin having a first end that is received in the transverse hole of the column, with the first end of the pin having a receptacle for receiving another end of the elastic element, the pin further having a second end received in the groove of the pawl, the second end of the pin being biased by the elastic element to be selectively, securely engaged in one of the first corner and the second corner of the groove of the pawl that corresponds to said one of the positions of the switch member relative to the handle.

14. The wrench as claimed in claim 13, wherein an inner periphery defining the compartment includes an annular groove in a lower end thereof, the outer periphery of the drive member including an annular groove in a lower end thereof, with the wrench further comprising a C-clip engaged in the annular groove of the compartment and the annular groove of the drive member, thereby rotatably mounting the drive member in the compartment.

15. The wrench as claimed in claim 13, wherein the transverse hole of the column of the switch member is a through-hole.

16. The wrench as claimed in claim 14, wherein the transverse hole of the column of the switch member is a through-hole.

17. The wrench as claimed in claim 13, wherein the switch member comprises an enlarged head located outside the vertical portion of the cavity and extended from the column, a thumb piece extending radially outward from the enlarged head for manual operation by a user to move the switch member between the two positions.

18. The wrench as claimed in claim 14, wherein the switch member comprises an enlarged head located outside the vertical portion of the cavity and extended from the column, a thumb piece extending radially outward from the enlarged head for manual operation by a user to move the switch member between the two positions.

19. The wrench as claimed in claim 15, wherein the switch member comprises an enlarged head located outside the vertical portion of the cavity and extended from the column, a thumb piece extending radially outward from the enlarged head for manual operation by a user to move the switch member between the two positions.

20. The wrench as claimed in claim 16, wherein the switch member comprises an enlarged head located outside the vertical portion of the cavity and extended from the column, a thumb piece extending radially outward from the enlarged head for manual operation by a user to move the switch member between the two positions.

* * * * *